US008452018B2

(12) United States Patent
Kim et al.

(10) Patent No.: US 8,452,018 B2
(45) Date of Patent: May 28, 2013

(54) APPARATUS AND METHOD FOR ENCODING/DECODING MULTICHANNEL SIGNAL USING PHASE INFORMATION

(75) Inventors: Jung Hoe Kim, Yongin-si (KR); Eunmi Oh, Yongin-si (KR); Mi Young Kim, Yongin-si (KR); Ki Hyun Choo, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/483,954

(22) Filed: May 30, 2012

(65) Prior Publication Data

US 2012/0294447 A1 Nov. 22, 2012

Related U.S. Application Data

(63) Continuation of application No. 13/126,947, filed as application No. PCT/KR2009/006247 on Oct. 28, 2009.

(30) Foreign Application Priority Data

Oct. 30, 2008 (KR) ..... 10-2008-0107240

(51) Int. Cl.
*H04R 5/00* (2006.01)

(52) U.S. Cl.
USPC ..... 381/22

(58) Field of Classification Search
USPC ..... 381/22
See application file for complete search history.

(56) References Cited

U.S. PATENT DOCUMENTS

| | | | | |
|---|---|---|---|---|
| 7,961,890 | B2 * | 6/2011 | Holzer et al. | 381/23 |
| 8,019,350 | B2 * | 9/2011 | Purnhagen et al. | 455/450 |
| 8,111,829 | B2 * | 2/2012 | Choo et al. | 381/10 |
| 8,145,498 | B2 * | 3/2012 | Herre et al. | 704/500 |
| 8,179,977 | B2 * | 5/2012 | Oh et al. | 375/240.25 |
| 8,254,584 | B2 * | 8/2012 | Kim et al. | 381/2 |

FOREIGN PATENT DOCUMENTS

| | | |
|---|---|---|
| EP | 1 427 252 A1 | 6/2004 |
| WO | 2005/086139 A1 | 9/2005 |

OTHER PUBLICATIONS

International Search Report for PCT/KR2009/006247 issued Mar. 3, 2010 [PCT/ISA/210].
Written Opinion for PCT/KR2009/006247 issued Mar. 3, 2010 [PCT/ISA/237].

* cited by examiner

*Primary Examiner* — Susan McFadden
(74) *Attorney, Agent, or Firm* — Sughrue Mion, PLLC

(57) ABSTRACT

An apparatus and method for encoding/decoding a multi-channel signal may be provided. The apparatus of encoding a multi-channel signal may insert information about whether to encode a phase parameter indicating phase information of a plurality of channels, included in the multi-channel signal, in a bitstream of the multi-channel signal. The apparatus of decoding a multi-channel signal may determine whether to up-mix a mono signal using the phase parameter based on the information about whether to encode.

4 Claims, 13 Drawing Sheets

FIG. 4

| Syntax | No. of bits |
|---|---|
| SpatialSpecificConfig() | |
| { | |
| bsSamplingFrequencyIndex; | 4 |
| if ( bsSamplingFrequencyIndex == 0xf ) { | |
| bsSamplingFrequency; | 24 |
| } | |
| bsFrameLength; | 7 |
| bsFreqRes; | 3 |
| bsTreeConfig; | 4 |
| bsQuantMode; | 2 |
| bsOneIcc; | 1 |
| bsArbitraryDownmix; | 1 |
| bsFixedGainSur; | 3 |
| bsFixedGainLFE; | 3 |
| bsFixedGainDMX; | 3 |
| bsMatrixMode; | 1 |
| bsTempShapeConfig; | 2 |
| bsDecorrConfig; | 2 |
| bs3DaudioMode; | 1 |
| if (bsTreeConfig == 0x7) { | |
| bs212Mode; | 1 |
| bsPhaseMode; 410 | 1 |
| } | |
| for (i=0; i<numOttBoxes; i++) { 420 | |
| OttConfig(i); | |
| } | |
| for (i=0; i<numTttBoxes; i++) { | |
| TttConfig(i); | |
| } | |
| if (bsTempShapeConfig == 2) { | |
| bsEnvQuantMode | 1 |
| } | |
| if (bs3DaudioMode) { | |
| bs3DaudioHRTFset; | 2 |
| if (bs3DaudioHRTFset==0) { | |
| ParamHRTFset(); | |
| } | |
| } | |
| ByteAlign(); | |
| SpatialExtensionConfig(); | |
| { | |

FIG. 5

| Syntax | No. of bits |
|---|---|
| OttConfig(i) | |
| { | |
| if (ottModeLfe[i]) { | |
| bsOttBands[i]; | 5 |
| } | |
| else { | |
| bsOttBands[i] = numBands; | |
| if(bsTreeConfig == 0x7 && bsPhaseMode) { | |
| bsOttBandsPhase[i]; | nbitsbands Phase |
| } | |
| } | |
| } | |

510

(a)

| bsFreqRes | numBands | nBitsBandsPhase (full band) | nBitsBandsPhase (low band) |
|---|---|---|---|
| 0 | Reserved | Reserved | Reserved |
| 1 | 28 | 5 | 4 |
| 2 | 20 | 5 | 4 |
| 3 | 14 | 4 | 4 |
| 4 | 10 | 4 | 3 |
| 5 | 7 | 0 | 0 |
| 6 | 5 | 0 | 0 |
| 7 | 4 | 0 | 0 |

(b)

| bsFreqRes | numBands | OttBandsPhase |
|---|---|---|
| 0 | Reserved | Reserved |
| 1 | 28 | 14 |
| 2 | 20 | 11 |
| 3 | 14 | 7 |
| 4 | 10 | 5 |
| 5 | 7 | 0 |
| 6 | 5 | 0 |
| 7 | 4 | 0 |

(c)

FIG. 6

```
Syntax
OttData()
{
    for (i=0; i<numOttBoxes; i++) {
        EcData(CLD, i, 0, bsOttBands[i]);
        }
        if (bsOneIcc) {
            EcData(ICC, 0, 0, numBands);
    } else {
                for (i=0; i<numOttBoxes; i++) {
                        if (!ottModeLfe[i]) {
                                EcData(ICC, i, 0, bsOttBands[i]);
                        }
                }
        }
    if(bsTreeConfig == 0x7 && bsPhaseMode) {
        for (i=0; i<numOttBoxes; i++) {
            EcDataIPD(i, 0, bsOttBandsPhase[i]);
            }
    }
}
```

610

FIG. 7

| Syntax | No. of bits |
|---|---|
| SpatialFrame() | |
| { | |
| FramingInfo(); | |
| bsIndependencyFlag; 710 | 1 |
| bsBipd | 1 |
| if (bsTreeConfig == 0x7) { | |
| bsPhaseMode; | 1 |
| } | |
| OttData(); | |
| TttData(); | |
| SmgData(); | |
| TempShapeData(); | |
| if (bsArbitraryDownmix != 0) { | |
| ArbitraryDownmixData(); | |
| } | |
| ByteAlign(); | |
| SpatialExtensionFrame(); | |
| } | |

FIG. 8

| Syntax | No. of bits |
|---|---|
| OttData() | |
| { | |
| for (i=0; i<numOttBoxes; i++) { | |
| EcData(CLD, i, 0, bsOttBands[i]); | |
| } | |
| if (bsOneIcc) { | |
| EcData(ICC, 0, 0, numBands); | |
| } else { | |
| for (i=0; i<numOttBoxes; i++) { | |
| if (!ottModeLfe[i]) { | |
| EcData(ICC, i, 0, bsOttBands[i]); | |
| } | |
| } | |
| } | |
| if(bsPhaseMode) { | |
| bsUpdateOttBandsPhase; | 1 |
| if (bsUpdateOttBandsPhase) { 810 | |
| for (i=0; i<numOttBoxes; i++) { | |
| bsOttBandsPhase[i]; | nBitsBands Phase |
| } | |
| } | |
| for (i=0; i<numOttBoxes; i++) { | |
| EcDataIPD(i, 0, bsOttBandsPhase[i]); 820 | |
| }} | |

(a)

| bsFreqRes | numBands | nBitsBandsPhase (full band) | Initial bsOttBandsPhase | nBitsBandsPhase (low band) |
|---|---|---|---|---|
| 0 | Reserved | Reserved | Reserved | Reserved |
| 1 | 28 | 5 | 14 | 4 |
| 2 | 20 | 5 | 11 | 4 |
| 3 | 14 | 4 | 12 | 4 |
| 4 | 10 | 4 | 5 | 3 |
| 5 | 7 | 0 | 0 | 0 |
| 6 | 5 | 0 | 0 | 0 |
| 7 | 4 | 0 | 0 | 0 |

(b)

APPARATUS AND METHOD FOR ENCODING/DECODING MULTICHANNEL SIGNAL USING PHASE INFORMATION

CROSS REFERENCE

This application is a continuation of U.S. application Ser. No. 13/126,947 filed Apr. 29, 2011, which is U.S. national stage of PCT/KR2009/006247 filed on Oct. 28, 2009, which claims priority to Korean Application No. 10-2008-0107240 filed Oct. 30, 2008.

TECHNICAL FIELD

Example embodiments relate to an apparatus and method for encoding/decoding a multi-channel signal, and more particularly, to an apparatus and method for encoding/decoding a multi-channel signal using phase information.

BACKGROUND ART

A Parametric Stereo (PS) technology may be used to encode a stereo signal. A PS technology may generate a mono signal by down-mixing an inputted stereo signal, extract a stereo parameter indicating side information of the stereo signal, and encode the generated mono signal and the extracted stereo parameter to encode the stereo signal.

In this instance, the stereo parameter may include an Inter-channel Intensity Difference (IID) or a Channel Level Difference (CLD), an Inter-Channel Coherence or Inter-Channel Correlation (ICC), an Inter-channel Phase Difference (IPD), an Overall Phase Difference (OPD), and the like. The IID or the CLD may indicate an intensity difference depending on an energy level of at least two channel signals included in a stereo signal. The ICC may indicate a correlation between at least two channel signals depending on coherence of waveforms of the at least two channel signals included in a stereo signal. The IPD may indicate a phase difference between at least two channel signals included in a stereo signal. The OPD may indicate how a phase difference between at least two channel signals, included in a stereo signal, is distributed between two channels based on a mono signal.

DISCLOSURE OF INVENTION

Technical Solutions

According to example embodiments, there is provided an encoding apparatus, including: a parameter encoding unit to determine whether to encode a phase parameter indicating phase information of a plurality of channels, to generate encoding information, and when it is determined to encode the phase parameter, to encode the phase parameter, the plurality of channels being included in a multi-channel signal; a mono signal encoding unit to encode a mono signal obtained by down-mixing the multi-channel signal; and a bitstream generation unit to generate a bitstream which the multi-channel signal is encoded using the encoded mono signal, the encoded phase parameter, and the encoding information, when it is determined to encode the phase parameter.

When it is determined to encode the phase parameter, the bitstream generation unit generates the bitstream which the multi-channel signal is encoded, using the encoded mono signal and the encoding information.

According to example embodiments, there is provided a decoding apparatus, including: a mono signal decoding unit to decode a mono signal, which is a down-mix signal of a multi-channel signal, from a bitstream which the multi-channel signal is encoded; a frequency band determination unit to ascertain whether a phase parameter of a plurality of channels exists in the bitstream, and when the phase parameter exists in the bitstream, to determine a frequency band of the mono signal which the phase parameter is to be applied; a parameter decoding unit to decode the phase parameter from the bitstream; and an up-mixing unit to up-mix the mono signal by applying the phase parameter to the frequency band.

According to example embodiments, there is provided an encoding method, including: determining whether to encode a phase parameter indicating phase information of a plurality of channels, and generating encoding information, the plurality of channels being included in a multi-channel signal; encoding the phase parameter when it is determined to encode the phase parameter; encoding a mono signal obtained by down-mixing the multi-channel signal; and generating a bitstream which the multi-channel signal is encoded using the encoded mono signal, the encoded phase parameter, and the encoding information, when it is determined to encode the phase parameter.

According to example embodiments, there is provided a decoding method, including: decoding a mono signal which is a down-mix signal of a multi-channel signal from a bitstream which the multi-channel signal is encoded; ascertaining whether a phase parameter of a plurality of channels exists in the bitstream, the plurality of channels being included in a multi-channel signal; determining a frequency band of the mono signal which the phase parameter is to be applied, when the phase parameter exists in the bitstream; decoding the phase parameter from the bitstream; and up-mixing the mono signal by applying the phase parameter to the frequency band.

Technical Goals

Example embodiments provide an apparatus and method for encoding/decoding a multi-channel signal that may reduce an amount of data required for data transmission.

Example embodiments also provide an apparatus and method for encoding/decoding a multi-channel signal that may provide a multi-channel audio signal with an improved sound quality.

BRIEF DESCRIPTION OF DRAWINGS

FIGS. 4 through 8 illustrate syntaxes associated with a bitstream generated by an encoding apparatus according to an example embodiment;

BEST MODE FOR CARRYING OUT THE INVENTION

Figure 1:
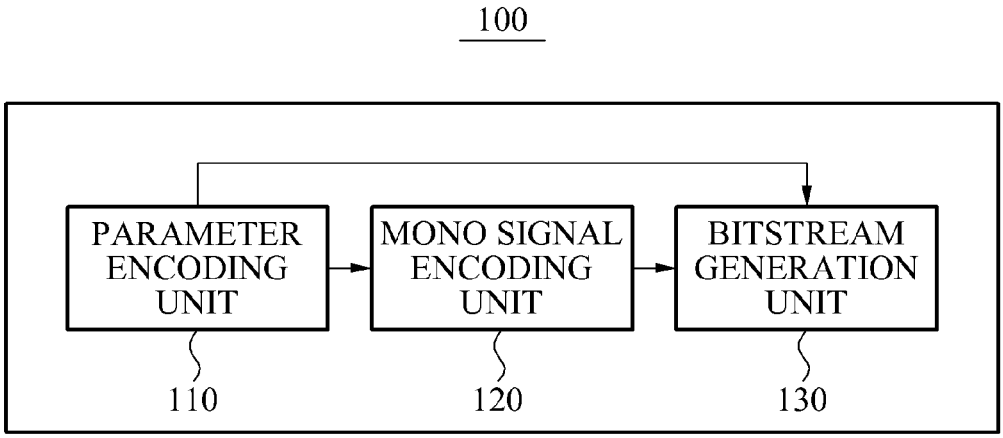
FIG. 1 is a block diagram illustrating an apparatus of encoding a multi-channel signal according to an example embodiment.

Reference will now be made in detail to example embodiments, examples of which are illustrated in the accompanying drawings, wherein like reference numerals refer to the like elements throughout. Example embodiments are described below in order to explain example embodiments by referring to the figures.

FIG. 1 is a block diagram illustrating an apparatus 100 of encoding a multi-channel signal according to an example embodiment.

The apparatus of encoding a multi-channel signal, hereinafter, referred to as an encoding apparatus 100, may include a parameter encoding unit 110, a mono signal encoding unit 120, and a bitstream generation unit 130. Here, the multi-channel signal may indicate a signal of a plurality of channels, and each of the plurality of channels included in the multi-channel signal may be referred to as a channel signal.

Hereinafter, it may be assumed that the encoding apparatus 100 encodes a stereo signal including a left channel signal (L) and a right channel signal (R) for convenience of description. However, it is apparent to those skilled in the related art that the encoding apparatus 100 may not be limited to encode the stereo signal, and may encode a multi-channel signal.

The parameter encoding unit 110 may determine whether to encode a phase parameter, and generate encoding information. When it is determined to encode the phase parameter, the parameter encoding unit 110 may encode the phase parameter. Here, the phase parameter may indicate phase information of a plurality of channels, and the multi-channel signal or a stereo signal may be configured as the plurality of channels. Hereinafter, the multi-channel signal or stereo signal may be referred to as a stereo signal.

As described above, a stereo parameter, used when the stereo signal is decoded using a Parametric Stereo (PS) technology, may include a Channel Level Difference (CLD), an Inter-Channel Coherence or Inter-Channel Correlation (ICC), an Inter-channel Phase Difference (IPD), an Overall Phase Difference (OPD), and the like.

For example, the parameter encoding unit 110 may include a parameter extraction unit. In this case, the stereo parameter may be extracted by the parameter extraction unit.

In this instance, the parameter encoding unit 110 may determine whether to encode the phase parameter, indicating phase information of the plurality of channels, from the extracted stereo parameter, and generate encoding information. That is, the encoding information may indicate whether the phase parameter is included in a bitstream generated by encoding the stereo signal. Here, the bitstream may be generated by the bitstream generation unit 130. It may be determined whether to encode the phase parameter based on a significance of phase information in the stereo signal to be transmitted. Also, the parameter encoding unit 110 may encode the CLD and the ICC.

According to an example embodiment, the encoding information may be represented by a single bit. When an encoded phase parameter is included in the bitstream, the bit may have a value of '1', and when the encoded phase parameter is not included in the bitstream, the bit may have a value of '0'.

When it is determined to encode the phase parameter, the parameter encoding unit 110 may encode the phase parameter, and generate encoding information having a value of '1'. When it is determined not to encode the phase parameter, the parameter encoding unit 110 may not encode the phase parameter, and generate encoding information having a value of '0'.

According to an example embodiment, the phase parameter may include both IPD and OPD, or include only IPD. Since the OPD may be estimated using the IPD or another stereo parameter, the phase parameter may include only the IPD, which is described in greater detail with reference to FIG. 3.

According to an example embodiment, the parameter encoding unit 110 may include a down-mixing unit. The down-mixing unit may generate a mono signal by down-mixing the stereo signal.

A mono signal of a single channel may be generated from a stereo signal of at least two channels through down-mixing, and down-mixing may reduce bit amount assigned during encoding. In this instance, the mono signal may represent the stereo signal. That is, the encoding apparatus 100 may encode only the mono signal and transmit the encoded mono signal, without encoding each of a left channel signal and a right channel signal included in the stereo signal. For example, a magnitude of the mono signal may be obtained using an average magnitude of the left channel signal and the right channel signal. Also, a phase of the mono signal may be obtained using an average phase of the left channel signal and the right channel signal.

The mono signal encoding unit 120 may encode the mono signal obtained by down-mixing the stereo signal.

For example, when the stereo signal is a voice signal, the mono signal encoding unit 120 may encode the mono signal based on a Code Excited Linear Prediction (CELP) scheme.

Also, for example, when the stereo signal is a music signal, the mono signal encoding unit 120 may encode the mono signal using a scheme similar to a Moving Picture Experts Group (MPEG)-2/4 Advanced Audio Coding (AAC) or an MPEG Audio-Layer 3 (MP3).

The bitstream generation unit 130 may generate the bitstream which the stereo signal is encoded, using the encoded mono signal.

According to an example embodiment, when it is determined to encode the phase parameter, the bitstream generation unit 130 may generate the bitstream which the stereo signal is encoded using the encoded mono signal, the encoded phase parameter, and the encoding information. For example, the bitstream generation unit 130 may generate the bitstream by multiplexing the encoded mono signal, the encoded phase parameter, and the encoding information.

According to another example embodiment, when it is determined not to encode the phase parameter, the bitstream generation unit 130 may generate the bitstream which the stereo signal is encoded, using the encoded mono signal and the encoding information. In this case, the bitstream generation unit 130 may generate the bitstream using a multiplexing scheme.

Also, as described above, the parameter encoding unit 110 may encode the CLD and the ICC. Accordingly, the bitstream generation unit 130 may use the CLD and ICC, encoded when the bitstream is generated, regardless of whether to encode the phase parameter.

That is, the encoding apparatus 100 according to an example embodiment may selectively encode the phase parameter, insert the phase parameter to the bitstream, and transmit the bitstream. Accordingly, compared to when a stereo signal is encoded/decoded without using a phase parameter, the encoding apparatus 100 may provide a stereo signal with an improved sound quality. Also, compared to when a stereo signal is encoded/decoded using a phase parameter every time, the encoding apparatus 100 may reduce an amount of data to be transmitted.

As described above, whether to encode the phase parameter may be determined based on the significance of the phase information in the stereo signal to be transmitted. According to an example embodiment, the parameter encoding unit 110 may determine whether to encode the phase parameter based on at least one of a difference between a inter-channel coherence and a inter-channel correlation, and a continuity of the phase information of a plurality of frames included in the stereo signal.

That is, the difference is significant, which indicates that the phase information may be perceptually significant. Accordingly, the parameter encoding unit 110 may determine to encode the phase parameter. The coherence of the plurality of channels may be the coherence of the plurality of channels using the phase information.

Also, a phase value of the plurality of frames sequentially changes, which indicates that a stereo image may sequentially change depending on the phase. Accordingly, the parameter encoding unit 110 may determine that the phase parameter is to be encoded. Conversely, when the phase value randomly changes, the parameter encoding unit 110 may determine that the phase parameter is not to be encoded.

According to an example embodiment, the bitstream, generated by the bitstream generation unit 130, may include a header and a plurality of frames. The encoding information may be inserted into the header and each of the plurality of frames.

When the encoding apparatus 100 up-mixes the mono signal using the phase parameter, the phase parameter as well as frequency band information of the mono signal which the phase parameter is to be applied may be required. The information about the frequency band may be information about to which frequency band the phase parameter is used when the mono signal is up-mixed.

Thus, according to an example embodiment, when it is determined to encode the phase parameter, the bitstream generation unit 130 may generate the bitstream by further using the frequency band information of the mono signal. In this instance, the frequency band information may indicate information about a frequency band which the phase parameter is to be applied when the mono signal is up-mixed. That is, the frequency band information may indicate information about a frequency band which the phase parameter is to be applied when the encoding apparatus 100 up-mixes the mono signal.

According to an example embodiment, the frequency band information may include a number of frequency bands which the phase parameter is to be applied. In this instance, a number of low frequency bands may be the same as the number of frequency bands that may be selected as the frequency band which the phase parameter is to be applied, from a plurality of frequency bands of the mono signal.

For example, when a frequency of the mono signal is divided into 28 frequency bands, and the number of frequency bands is greater than 14, the frequency band which the phase parameter is to be applied may be 14 frequency bands with a low frequency, since the phase parameter may be significant in a low frequency band.

In this instance, when the frequency of the mono signal is divided into seven or fewer frequency bands, significance of the bitstream may be reduced. Accordingly, the number of frequency bands may be zero. That is, the phase parameter may not be used when the mono signal is up-mixed.

According to an example embodiment, the parameter encoding unit 110 may further encode at least one of the CLD and the ICC, and the bitstream generation unit 130 may generate the bitstream further using at least one of the CLD and the ICC. Accordingly, a number of bits may be determined based on the number of frequency bands which the at least one of the CLD and the ICC is to be applied, when the mono signal is up-mixed. The number of bits may represent the frequency band information.

That is, the number of frequency bands which the phase parameter is to be applied may be determined based on the number of frequency bands which the CLD or the ICC is to be applied. For example, the number of frequency bands which the phase parameter is to be applied may be equal to the number of frequency bands which the CLD or the ICC is to be applied. Also, there may be twice the number of frequency bands which the CLD or the ICC is to be applied as the number of frequency bands which the phase parameter is to be applied.

According to an example embodiment, the frequency band information may further include information about whether to update the number of frequency bands which the phase parameter is to be applied.

That is, the information about whether to update may indicate whether a number of frequency bands which the phase parameter is to be applied in a current frame which encoding is being performed is equal to a number of frequency bands which the phase parameter is to be applied in a previous frame.

For example, the information about whether to update may be represented by a single bit. When the number of frequency bands which the phase parameter is to be applied in the current frame is different from the number of frequency bands which the phase parameter is to be applied in the previous frame, the bit may have a value of '1'. When the number of frequency bands which the phase parameter is to be applied in the current frame is equal to the number of frequency bands which the phase parameter is to be applied in the previous frame, the bit may have a value of '0'.

When the information about whether to update has a value of '1', the frequency band information may include information about a number of frequency bands of a mono signal which the phase parameter is to be applied. Conversely, when the information about whether to update has a value of '0', the frequency band information may not include information about the number of frequency bands of the mono signal which the phase parameter is to be applied.

As described above, the encoding apparatus 100 may use the information about whether to update, and thereby may prevent unnecessary information from being repeatedly encoded and reduce an amount of data to be transmitted.

According to an example embodiment, the frequency band information may be inserted into the header or each of the plurality of frames. For example, when encoding information is inserted into the header, the frequency band information may also be inserted into the header. When the encoding information is inserted into each of the plurality of frames, the frequency band information may be inserted into each of the plurality of frames.

According to an example embodiment, the parameter encoding unit 110 may compare phase information of a plurality of frames included in the multi-channel signal, and determine whether to encode the phase parameter.

That is, when phase information in a current frame is identical to phase information in a previous frame, the parameter encoding unit 110 may not encode the phase parameter. In this instance, the parameter encoding unit 110 may generate phase parameter update information indicating the phase parameter is not updated. Also, the phase parameter update information may be included in the bitstream and transmitted.

When the phase parameter is not updated, the encoding apparatus 100 may up-mix the mono signal using a phase parameter in the previous frame.

Figure 2:
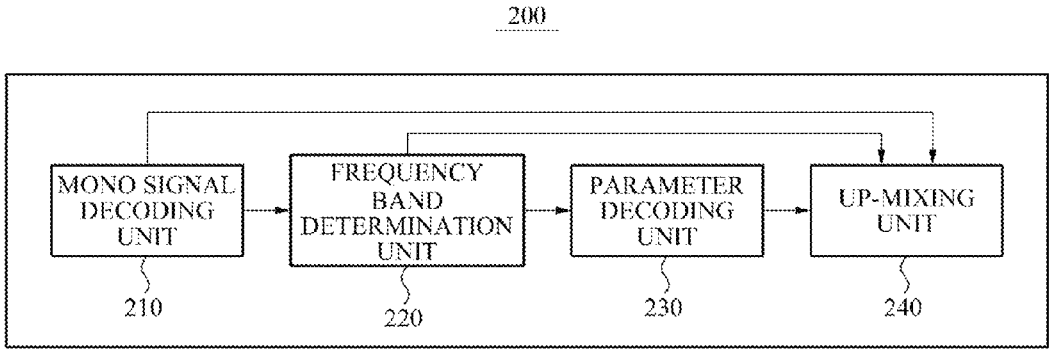
FIG. 2 is a block diagram illustrating an apparatus of decoding a multi-channel signal according to an example embodiment.

FIG. 2 is a block diagram illustrating an apparatus 200 of decoding a multi-channel signal according to an example embodiment.

The apparatus 200 of decoding a multi-channel signal, hereinafter, referred to as a decoding apparatus 200, may include a mono signal decoding unit 210, a frequency band determination unit 220, a parameter decoding unit 230, and an up-mixing unit 240.

Hereinafter, it may be assumed that a bitstream, inputted to the decoding apparatus 200, is a bitstream which a stereo signal is encoded for convenience of description.

Also, it may be assumed that the inputted bitstream is demultiplexed into an encoded mono signal, an encoded stereo parameter, and encoded frequency band information.

The mono signal decoding unit 210 may decode a mono signal which is a down-mix signal of the multi-channel signal from the bitstream which the multi-channel signal or the stereo signal is encoded. Hereinafter, the multi-channel signal or the stereo signal may be referred to as a stereo signal. Specifically, when a mono signal is encoded in a time domain, the mono signal decoding unit 210 may decode the encoded mono signal in the time domain. When the mono signal is encoded in a frequency domain, the mono signal decoding unit 210 may decode the encoded mono signal in the frequency domain.

The frequency band determination unit 220 may ascertain whether a phase parameter of a plurality of channels exists in the bitstream. The plurality of channels may be included in a multi-channel signal. When the phase parameter exists in the bitstream, the frequency band determination unit 220 may determine a frequency band of a mono signal which the phase parameter is to be applied.

For example, the frequency band determination unit 220 may ascertain encoding information, included in the bitstream, and thereby may ascertain whether the phase parameter exists in the bitstream.

The parameter decoding unit 230 may decode the phase parameter of the plurality of channels from the bitstream. For example, the parameter decoding unit 230 may decode the encoding information, included in the bitstream, and thereby may determine whether the phase parameter is included in the bitstream. When the phase parameter is included in the bitstream, the parameter decoding unit 230 may decode the phase parameter.

Also, the parameter decoding unit 230 may decode other stereo parameters included in the bitstream such as a CLD, an ICC, and the like.

As described above, the phase parameter may include both IPD and OPD, and include only the IPD. When the phase parameter includes both IPD and OPD, the parameter decoding unit 230 may decode the IPD and the OPD from the bitstream.

When the phase parameter includes only the IPD, the OPD may be estimated from the IPD and the other stereo parameters. Here, it may be assumed that the OPD may be estimated by an OPD estimation unit included in the parameter decoding unit 230, and the OPD estimation unit is described in detail. Here, it may be apparent to those skilled in the related art that Equations described below may be simply example embodiments and may vary.

The OPD estimation unit may calculate a first intermediate variable c using an IID according to Equation 1 given as below.

$$c(b) = 10^{\frac{IID(b)}{20}} \quad \text{[Equation 1]}$$

which b may denote an index of a frequency band. As Equation 1, the first intermediate variable c may be obtained by representing a value, obtained by dividing an IID in a predetermined frequency band by 20, as an exponent of 10. In this instance, a second intermediate variable $c_1$ and a third intermediate variable $c_2$ may be obtained by using the first intermediate variable c according to Equation 2 and Equation 3 given as below.

$$c_1(b) = \frac{\sqrt{2}}{\sqrt{1 + c^2(b)}} \quad \text{[Equation 2]}$$

$$c_2(b) = \frac{\sqrt{2}\, c(b)}{\sqrt{1 + c^2(b)}} \quad \text{[Equation 3]}$$

That is, the third intermediate variable $c_2$ may be obtained by multiplying the second intermediate variable $c_1$ with c(b).

Also, a first left channel signal and a first right channel signal may be represented using the decoded mono signal, the second intermediate variable $c_1$ and the third intermediate variable $c_2$, according to Equation 4 and Equation 5 given as below.

$$\hat{R}_{n,k} = c_1 M_{n,k} \quad \text{[Equation 4]}$$

which n and k may denote a time slot index and a parameter band index. The first right channel signal $\hat{R}_{n,k}$ may be represented as a multiplication of the second intermediate variable $c_1$ and the decoded mono signal M.

$$\hat{L}_{n,k} = c_2 M_{n,k} \quad \text{[Equation 5]}$$

The first left channel signal $\hat{L}_{n,k}$ may be represented as a multiplication of the third intermediate variable $c_2$ and the decoded mono signal M.

In this instance, when a value of the IPD is $\phi$, a first mono signal $\hat{M}_{n,k}$ may be represented using the first right channel signal $\hat{R}_{n,k}$ and the first left channel signal $\hat{L}_{n,k}$ as Equation 6 given as below.

$$|\hat{M}_{n,k}| = \sqrt{|\hat{L}_{n,k}|^2 + |\hat{R}_{n,k}|^2 - 2|\hat{L}_{n,k}||\hat{R}_{n,k}|\cos(\pi - \phi)} \quad \text{[Equation 6]}$$

Also, using Equation 3 through Equation 6, a fourth intermediate variable p associated with the time slot and parameter band may be obtained according to Equation 7 given as below.

$$p_{n,k} = \frac{|\hat{L}_{n,k}| + |\hat{R}_{n,k}| + |\hat{M}_{n,k}|}{2} \quad \text{[Equation 7]}$$

which the fourth intermediate variable p may be calculated by dividing a value by two. Here, the value may be obtained by summing magnitudes of the first left channel signal, the first right channel signal, and the first mono signal. In this instance, when a value of the OPD is $\phi_1$, the OPD may be obtained by, $$\varphi_1 = 2\arctan\left(\sqrt{\frac{(p_{n,k} - |\hat{L}_{n,k}|)(p_{n,k} - |\hat{M}_{n,k}|)}{p_{n,k}(p_{n,k} - |\hat{R}_{n,k}|)}}\right) \quad \text{[Equation 8]}$$

Also, when a difference between the OPD and the IPD is $\phi_2$, $\phi_2$, may be obtained by, $$\varphi_2 = 2\arctan\left(\sqrt{\frac{(p_{n,k} - |\hat{R}_{n,k}|)(p_{n,k} - |\hat{M}_{n,k}|)}{p_{n,k}(p_{n,k} - |\hat{L}_{n,k}|)}}\right) \quad \text{[Equation 9]}$$

$\phi_1$, the value of the OPD obtained according to Equation 8, may denote a phase difference between the decoded mono signal and a left channel signal to be up-mixed. $\phi_2$ obtained according to Equation 9 may denote a phase difference between the decoded mono signal and a right channel signal to be up-mixed.

Accordingly, the OPD estimation unit may generate the first left channel signal and the first right channel signal with respect to the left channel signal and the right channel signal, from the decoded mono signal using the IID indicating an inter-channel intensity difference of stereo signals. Also, the OPD estimation unit may generate the first mono signal from the first left channel signal and the first right channel signal using the IPD indicating an inter-channel phase difference of stereo signals. Also, the OPD estimation unit may estimate the OPD value using the generated first left channel signal, first right channel signal, and first mono signal. The OPD value may indicate a phase difference between the decoded mono signal and the stereo signal.

The up-mixing unit 240 may up-mix the mono signal by applying the phase parameter to the frequency band to decode the stereo signal.

A stereo signal of at least two channels may be generated from a mono signal of a single channel through up-mixing. Up-mixing may be converse to be opposite to down-mixing.

The up-mixing unit 240 may up-mix the mono signal by applying the other stereo parameters such as the CLD, the ICC, and the like. Hereinafter, an operation of the up-mixing unit 240 that performs up-mixing using the CLD, ICC, IPD, and OPD is described in detail.

When a value of ICC is $\rho$, the up-mixing unit 240 may obtain a first phase $\alpha+\beta$ and a second phase $\alpha-\beta$, using the second intermediate variable $c_1$ and the third intermediate variable $c_2$, according to Equation 10 and Equation 11 given as below.

$$\alpha + \beta = \frac{1}{2}\arccos\rho \cdot \left(1 + \frac{c_1 - c_2}{\sqrt{2}}\right) \quad \text{[Equation 10]}$$

$$\alpha - \beta = \frac{1}{2}\arccos\rho \cdot \left(1 - \frac{c_1 - c_2}{\sqrt{2}}\right) \quad \text{[Equation 11]}$$

When the decoded mono signal is M and a decorrelated signal is D, according to Equation 12 and Equation 13, the up-mixing unit 240 may obtain an up-mixed left channel signal and right channel signal, using the first phase and the second phase, obtained according to Equation 10 and Equation 11, the second intermediate variable $c_1$ and the third intermediate variable $c_2$, the OPD value $\phi_1$ obtained according to Equation 8, and the $\phi_2$ obtained according to Equation 9.

$$L' = (M \cdot \cos(\alpha+\beta) + D \cdot \sin(\alpha+\beta)) \cdot \exp(j\phi_1) \cdot c_2 \quad \text{[Equation 12]}$$

$$R' = (M \cdot \cos(\alpha-\beta) - D \cdot \sin(\alpha-\beta)) \cdot \exp(j\phi_2) \cdot c_1 \quad \text{[Equation 13]}$$

As described above, the decoding apparatus 200 may estimate the OPD value using the other parameters, transmitted from the encoding apparatus 100, without receiving the OPD value from the encoding apparatus 100. Accordingly, types of parameters used for up-mixing may increase and a sound quality of an up-mixed stereo signal may be improved.

According to an example embodiment, the decoding apparatus 200 may include a table which frequency band information about a frequency band is stored. Also, the frequency band determination unit 220 may select frequency band information corresponding to the mono signal from the table, and determine the frequency band.

That is, when the encoding apparatus 100 and the decoding apparatus 200 share the table storing the frequency band information, the encoding apparatus 100 and the decoding apparatus 200 may select information about a frequency band which a phase parameter is to be applied by referring to the table, and determine the frequency band which the phase parameter is to be applied.

Also, according to an example embodiment, the frequency band determination unit 220 may decode the frequency band information about the frequency band from the bitstream, and determine the frequency band based on the decoded frequency band information.

That is, the frequency band determination unit 220 may directly decode the frequency band information from the bitstream, and determine the frequency band using the decoded frequency band information.

According to an example embodiment, the frequency band determination unit 220 may decode the frequency band information from a header or each of a plurality of frames of the bitstream.

That is, the frequency band information may be inserted into the header or each of the plurality of frames of the inputted bitstream. In this instance, the frequency band determination unit 220 may decode the frequency band information from the header or each of the plurality of frames of the inputted bitstream.

According to an example embodiment, the frequency band information may include a number of frequency bands which the phase parameter is to be applied.

When the frequency band information includes the number of frequency bands which the phase parameter is to be applied, the frequency band determination unit 220 may determine a same number of low frequency bands as the number of frequency bands which the phase parameter is to be applied, from a plurality of frequency bands of the mono signal.

For example, when a frequency of the mono signal is divided into 28 frequency bands, and the number of frequency bands is 14, the frequency band which the phase parameter is to be applied may be 14 frequency bands with a low frequency. In this instance, when the number of frequency bands is zero, the phase parameter may not be used when up-mixing the mono signal.

Also, according to an example embodiment, the frequency band information may further include information about whether to update the number of frequency bands which the phase parameter is to be applied.

In this instance, the frequency band determination unit 220 may analyze the information about whether to update.

When the number of frequency bands which the phase parameter is to be applied is updated, the frequency band determination unit 220 may extract the number of frequency bands which the phase parameter is to be applied, from the bitstream, and determine a frequency band which the phase parameter is to be applied, based on the updated number of frequency bands.

Conversely, when the number of frequency bands which the phase parameter is to be applied is not updated, the frequency band determination unit 220 may determine the frequency band which the phase parameter is to be applied, based on a number of frequency bands in a previous frame.

Figure 3:
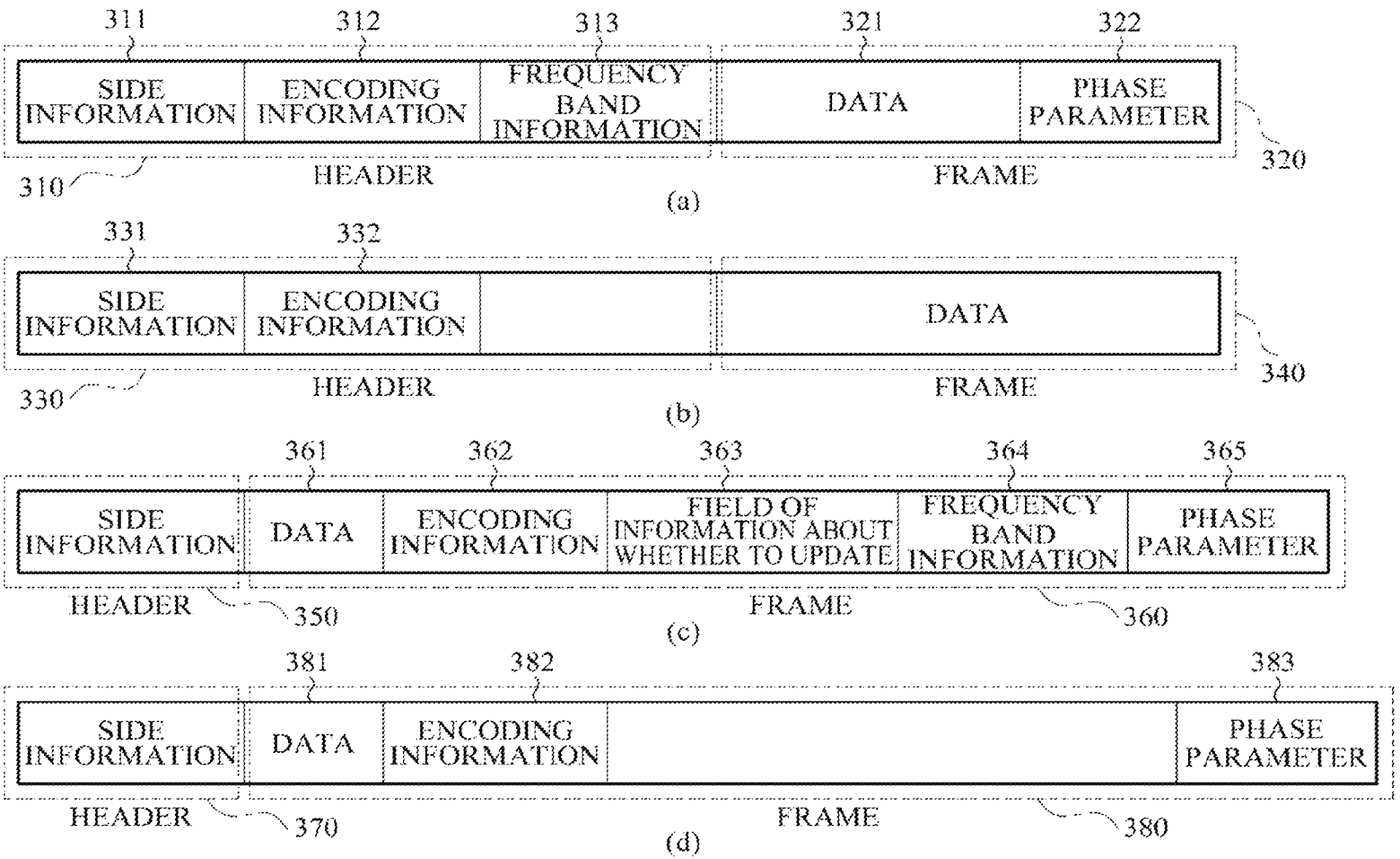
FIG. 3 is a diagram illustrating a configuration of a bitstream of a multi-channel signal encoded by an encoding apparatus according to an example embodiment.

FIG. 3 is a diagram illustrating a configuration of a bitstream of a multi-channel signal encoded by an encoding apparatus according to an example embodiment.

As described above, encoding information and frequency band information may be inserted into a header or a frame of a bitstream.

FIG. 3 (*a*) illustrates a configuration of the bitstream which the encoding information and the frequency band information are inserted into the header 310 of the bitstream. In FIG. 3 (*a*), the header 310 may include a side information field 311, an encoding information field 312, and a frequency band information field 313.

The side information field 311 may include various information used when multi-channel data is encoded/decoded. For example, the side information field 311 may include information about a number of frequency bands of a CLD and an ICC.

The encoding information field 312 may include information about whether a phase parameter exists in the bitstream. As described above, the encoding information field 312 may be represented by a single bit. Also, when the phase parameter is included in the bitstream, the bit may have a value of '1'. When the phase parameter is not included in the bitstream, the bit may have a value of '0'. The phase parameter may be stored in a phase parameter field 322 of each of a plurality of frames 320.

The frequency band information field 313 may include information about a frequency band which the phase parameter is to be applied when a mono signal is up-mixed. For example, when the information about the frequency band indicates a number of frequency bands which the phase parameter is to be applied, a frequency band which the phase parameter is to be applied may be represented as maximum 28 frequency bands. Accordingly, the frequency band information field 313 may have a length of five bits.

The phase parameter may be stored in the phase parameter field 322 of each of the plurality of frames 320.

FIG. 3 (*b*) illustrates a configuration of the bitstream which only encoding information is inserted into the header 330 of the bitstream. In FIG. 3 (*b*), the header 330 may include only side information field 331 and encoding information field 332, as opposed to a frequency band information field.

In this instance, the encoding apparatus 100 and the decoding apparatus 200 may include a table storing frequency band information. In this instance, the encoding apparatus 100 and the decoding apparatus 200 may select information about a frequency band which a phase parameter is to be applied by referring to the table, and determine the frequency band which the phase parameter is to be applied. For example, the encoding apparatus 100 and the decoding apparatus 200 may determine the frequency band information by searching the table based on information about a number of frequency bands of a CLD and an ICC. Here, the CLD and the ICC may exist in the side information field 331 of the header 330.

FIG. 3 (*c*) illustrates a configuration of the bitstream which encoding information and frequency band information are inserted into a frame 360 of the bitstream.

In this instance, a header 350 may include only a side information field. The frame 360 may include a data field 361, an encoding information field 362, a field 363 of information about whether to update frequency band information, a frequency band information field 364, and a phase parameter field 365.

The encoding information field 362, the frequency band information field 364, and the phase parameter field 365 may be the same as the encoding information field 312, the frequency band information field 313, and the phase parameter field 322 of FIG. 3 (*a*), and thus further detailed description is omitted here.

The field 363 of information about whether to update frequency band information may include information about whether frequency band information which the phase parameter is to be applied in a current frame is identical to frequency band information which the phase parameter is to be applied in a previous frame.

As described above, the field 363 may be represented by a single bit. When the frequency band information in the current frame is different from the frequency band information in the previous frame, the bit may have a value of '1'. When the frequency band information in the current frame is identical to the frequency band information in the previous frame, the bit may have a value of '0'.

When the information about whether to update has a value of '0', the frequency band information in the current frame is identical to the frequency band information in the previous frame, and thus the frequency band information field 364 may be set as '0'. In this case, the decoding apparatus 200 may perform decoding using the frequency band information in the previous frame.

Accordingly, the encoding apparatus 100 may further use the information about whether to update the frequency band which the phase parameter is to be applied, and thereby may prevent unnecessary information from being repeatedly encoded and reduce an amount of data to be transmitted.

FIG. 3 (*d*) illustrates a configuration of the bitstream which only encoding information is inserted into a frame 380 of the bitstream. Frequency band information and information about whether to update the frequency band information may not be included in the bitstream.

As described above, when the encoding apparatus 100 and the decoding apparatus 200 include a table storing the frequency band information, the encoding apparatus 100 and the decoding apparatus 200 may select information about a frequency band which a phase parameter is to be applied by referring to the table, and determine the frequency band which the phase parameter is to be applied.

FIG. 4 through FIG. 8 illustrate syntaxes associated with a bitstream generated by an encoding apparatus according to an embodiment.

Syntaxes described below may be based on a syntax used in an MPEG Surround and an MPEG Unified Speech and audio coding technologies.

FIG. 4 through FIG. 6 illustrate syntaxes associated with encoding information inserted into a header of a bitstream. That is, syntaxes illustrated in FIG. 4 through FIG. 6 may be associated with the bitstream illustrated in FIGS. 3 (*a*) and (*b*).

The syntax of FIG. 4 may be associated with a header of the bitstream. As illustrated in FIG. 4, information of 'bsPhaseMode' 410 may be added.

The information of 'bsPhaseMode' 410 may indicate information about whether to encode and transmit a phase parameter, that is, encoding information. As described above, the information of 'bsPhaseMode' 410 may be represented by a single bit.

When frequency band information is inserted into the header of the bitstream, that is, when the bitstream of FIG. 3 (*a*) is generated, a syntax of 'OttConfig' 420 may change, as illustrated in FIG. 5 (*a*).

FIG. 5 (*a*) illustrates a syntax of 'OttConfig'. As illustrated in FIG. 5 (*a*), information of 'bsOttBandsPhase[i]' 510 may be further added.

The information of 'bsOttBandsPhase[i]' 510 may indicate a number of frequency bands which a phase parameter is to be applied. The information of 'bsOttBandsPhase[i]' 510 may be represented by a bit having a magnitude of 'nBitsBandsPhase'.

'Ott(One-To-Two)' may be used for stereo up-mixing. The number of frequency bands which the phase parameter is to be applied in 'Ott' may be determined in the syntax of 'OttConfig'. When the information of 'bsPhaseMode' is '1', that is, when the phase parameter is used, information about to which frequency band the phase parameter is used to up-mix a mono signal is required. In this instance, when information about the frequency band is inserted into the bitstream, the information may be represented using 'bsOttBandsPhase'. Information of 'bsFreqRes' may indicate a number of frequency bands of a CLD and an ICC, and be transmitted to the header. In general, since the information of 'bsFreqRes' may be represented as maximum 28 bands (numBands), five bits are required. When the frequency band which the phase parameter is to be applied is represented using 'nBitsBandsPhase', a maximum number of bands may be determined depending on the information of 'bsFreqRes'. Accordingly, bits may be dynamically assigned.

For example, when the information of 'bsFreqRes' has a value of four, a maximum number of CLD bands is ten. Accordingly, as represented in 'nBitsBandsPhase(full band)' of a table illustrated in FIG. 5 (*b*), a number of frequency bands may be represented using four bits.

Also, as described above, the phase parameter may be applied to only low frequency band. In this case, as represented in 'nBitsBandsPhase(low band)' of a table illustrated in FIG. 5 (*b*), a frequency band may be determined and bits may be dynamically assigned. In this instance, all the five bits may not be required to be used, as opposed to when the phase parameter is applied to all the frequency bands. Also, when the information of 'bsFreqRes' has a value equal to or greater than five, a number of bands of the CLD may be seven. In this instance, the phase parameter may not be used, and information of 'nBitsBandsPhase' may be '0' and may not be transmitted.

When the frequency band information is not inserted into the header of the bitstream, that is, when the bitstream of FIG. 3 (*b*) is generated, an encoding apparatus and decoding apparatus may have a table storing the frequency band information. FIG. 5 (*c*) illustrates an example of a table storing the frequency band information.

FIG. 6 illustrates a syntax of 'OttData' used when a phase parameter is encoded and inserted into each frame. In this instance, information of 'bsPhaseMode' may have a value of '1'. Information of 'EcDataIPD' 610 may indicate a result of lossless encoding with respect to the phase parameter.

The information of 'EcDataIPD' 610 may determine whether to maintain a value of a previous frame or whether to encode information of a current frame through lossless encoding, using a bit of 'bsIPDdataMode. When the phase parameter is meaningless in a predetermined audio period, the phase parameter may be set as '0' and encoded. Also, the bit of 'bsIPDDdataMode' may be set as '0' and transmitted. Accordingly, an unnecessary phase parameter may not be transmitted. Conversely, when the bit of 'bsIPDDdataMode' may be '1', the phase parameter may be encoded and transmitted.

FIG. 7 and FIG. 8 illustrate syntaxes associated with encoding information inserted into a frame of a bitstream. That is, syntaxes illustrated in FIG. 7 through FIG. 8 may be associated with the bitstream illustrated in FIGS. 3 (*c*) and (*d*).

The syntax of FIG. 7 may be associated with a frame of the bitstream. As illustrated in FIG. 7, information of 'bsPhaseMode' 710 may be added.

FIG. 8 (*a*) illustrates a syntax associated with 'Ottdata' included in the syntax of FIG. 7.

When frequency band information and information about whether to update the frequency band information are inserted into the frame, the syntax of FIG. 8 may be added.

Information of 'bsUpdateOttBandsPhase' may be information about whether to update a number of frequency bands which a phase parameter is to be applied in a current frame. When the information of 'bsUpdateOttBandsPhase' has a value of '1', the number of frequency bands is to be updated. Also, the number of frequency bands may be updated additionally using information of 'bsOttBandsPhase'. Conversely, when the information of 'bsUpdateOttBandsPhase' has a value of '0', the phase parameter may be decoded using a number of frequency bands which the phase parameter, used in the previous frame, is to be applied.

When information of 'bsPhaseMode' is '1', that is, when the phase parameter is used, information about frequency which band the phase parameter is used when a mono signal is up-mixed is required. In this instance, when information about the frequency band is inserted into the bitstream, the information may be represented using 'bsOttBandsPhase'. Information of 'bsFreqRes' may indicate a number of frequency bands of a CLD and an ICC, and be transmitted a header. In general, since the information of 'bsFreqRes' may be represented as a maximum of 28 bands (numBands), five bits are required to represent a frequency band. When the frequency band which the phase parameter is to be applied is represented using 'nBitsBandsPhase', a maximum number of bands may be determined depending on information of 'bsFreqRes'. Accordingly, bits may be dynamically assigned.

For example, when the information of 'bsFreqRes' has a value of four, a maximum number of CLD bands is ten. Accordingly, as represented in 'nBitsBandsPhase(full band)' of a table illustrated in FIG. 8 (*b*), a number of frequency bands may be represented using four bits.

Also, as described above, the phase parameter may be applied to only a low frequency band. In this case, as represented in 'nBitsBandsPhase(low band)' of a table illustrated in FIG. 8 (*b*), a frequency band may be determined and bits may be dynamically assigned. In this instance, all the five bits may not be required to be used, as opposed to when the phase parameter is applied to all the frequency bands. Also, when the information of 'bsFreqRes' has a value equal to or greater than five, a number of bands of the CLD may be seven. In this instance, the phase parameter may not be used, and information of 'nBitsBandsPhase' may be '0' and may not be transmitted. Before information of 'bsUpdateOttBandsPhase' is set as '1' and updated, the information of 'bsUpdateOttBandsPhase' may be initialized as 'Initial bsOttBandsPhase' of a table illustrated in FIG. 8 (*b*) and operated.

Information of 'EcDataIPD' 820 may indicate a result of lossless encoding with respect to the phase parameter.

When the frequency band information is not inserted into the frame of the bitstream, that is, when the bitstream of FIG. 3 (*d*) is generated, the encoding apparatus 100 and the decoding apparatus 200 may use a table, storing the frequency band information, as illustrated in FIG. 5 (*c*).

Figure 9:
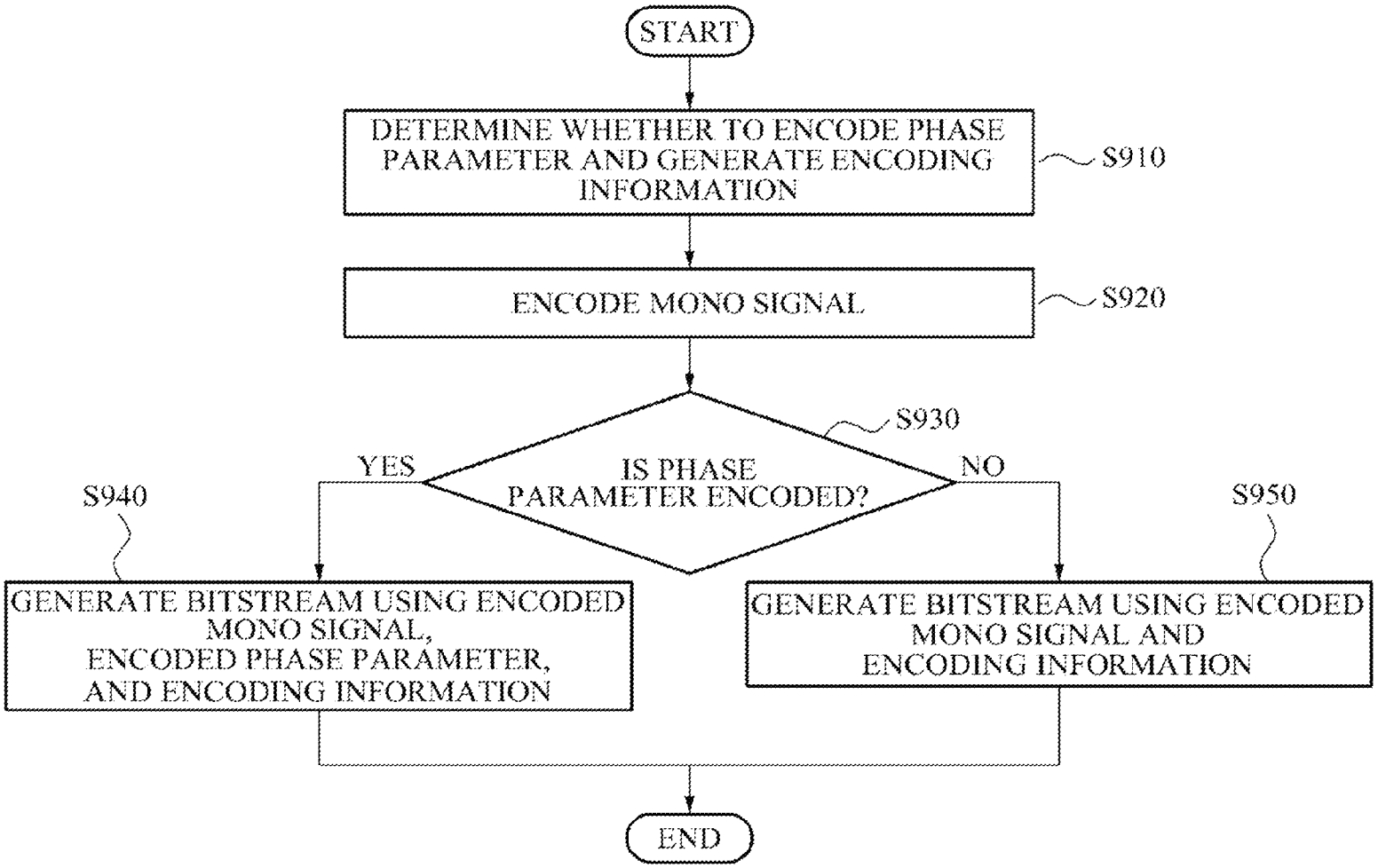
FIG. 9 is a flowchart illustrating a method of encoding a multi-channel signal; according to an example embodiment.

FIG. 9 is a flowchart illustrating a method of encoding a multi-channel signal according to an example embodiment.

Referring to FIG. 9, the method of encoding a multi-channel signal, hereinafter, referred to as an encoding method, may include operations time-series processed by an encoding apparatus of FIG. 1. Accordingly, descriptions about the encoding apparatus described above with reference to FIG. 1 may be applied to the encoding method according to an example embodiment.

In operation S910, whether to encode a phase parameter may be determined, and encoding information may be generated. The phase parameter may indicate phase information of a plurality of channels, and the plurality of channels may be included in a multi-channel signal.

According to an example embodiment, the phase parameter may include both IPD and OPD, and include only the IPD.

Also, according to an example embodiment, in operation S910, whether to encode may be determined based on at least one of a difference between a inter-channel coherence and a inter-channel correlation, and a continuity of the phase information of a plurality of frames included in the multi-channel signal.

In operation S920, a mono signal may be encoded. The mono signal may be obtained by down-mixing the multi-channel signal.

In operation S930, it is determined whether to encode the phase parameter.

When it is determined to encode the phase parameter in operation S930, a bitstream which the multi-channel signal is encoded using the encoded mono signal, the encoded phase parameter, and the encoding information in operation S940.

When it is determined not to encode the phase parameter in operation S930, a bitstream which the multi-channel signal is encoded using the encoded mono signal and the encoding information in operation S950.

According to an example embodiment, the bitstream, generated in operation S940 and S950, may include a header and a plurality of frames. The encoding information may be inserted into the header or each of the plurality of frames.

Also, according to an example embodiment, in operation S940, the encoded bitstream may be generated further using frequency band information.

Also, according to an example embodiment, the frequency band information may include a number of frequency bands which the phase parameter is to be applied, and also include information about whether to update the number of frequency bands which the phase parameter is to be applied.

Figure 10:
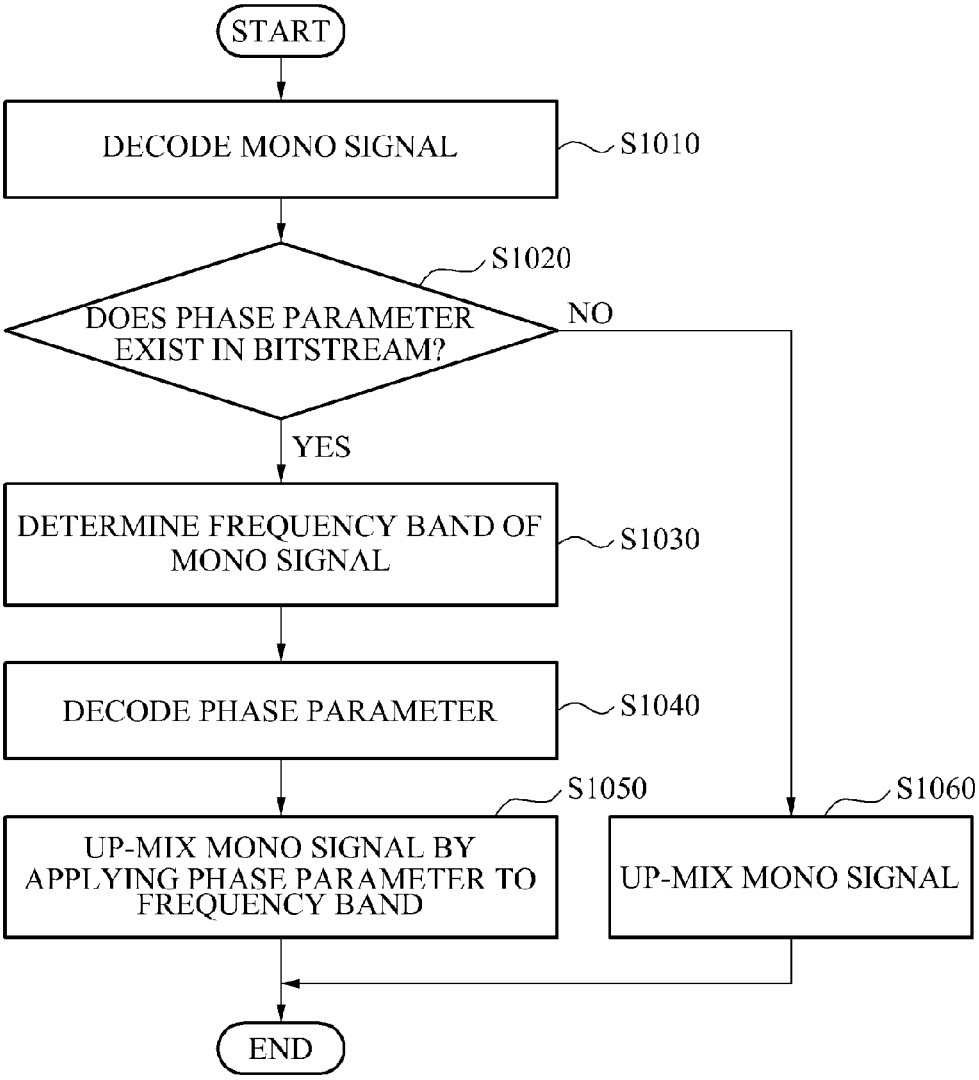
FIG. 10 is a flowchart illustrating a method of decoding a multi-channel signal according to an example embodiment.

FIG. 10 is a flowchart illustrating a method of decoding a multi-channel signal according to an example embodiment.

Referring to FIG. 10, the method of decoding a multi-channel signal, hereinafter, referred to as a decoding method, may include operations time-series processed by a decoding apparatus of FIG. 2. Accordingly, descriptions about the decoding apparatus described above with reference to FIG. 2 may be applied to the encoding method according to an example embodiment.

In operation S1010, a mono signal may be decoded. The mono signal may be a down-mix signal of the multi-channel signal from a bitstream which the multi-channel signal is encoded.

In operation S1020, it may ascertained whether a phase parameter of a plurality of channels exists in the bitstream.

When it is ascertained that the phase parameter exists in the bitstream in operation S1020, a frequency band of the mono signal which the phase parameter is to be applied may be determined in operation S1030.

In operation S1040, the phase parameter may be decoded. In operation S1050, the mono signal may be up-mixed by applying the phase parameter to the frequency band.

According to an example embodiment, in operation S1040, frequency band information corresponding to the mono signal may be selected from a table, and the frequency band may be determined. Frequency band information about the frequency band may be stored in the table.

Also, according to an example embodiment, in operation S1040, the frequency band information about the frequency band may be decoded from the bitstream.

Also, according to an example embodiment, in operation S1040, the frequency band information may be decoded from a header or each of a plurality of frames of the bitstream.

According to an example embodiment, the frequency band information may include a number of frequency bands which the phase parameter is to be applied, and also include information about whether to update the number of frequency bands which the phase parameter is to be applied.

When it is determined that the phase parameter does not exist in the bitstream in operation S1020, the mono signal may be up-mixed using only another stereo parameter.

Figure 11:
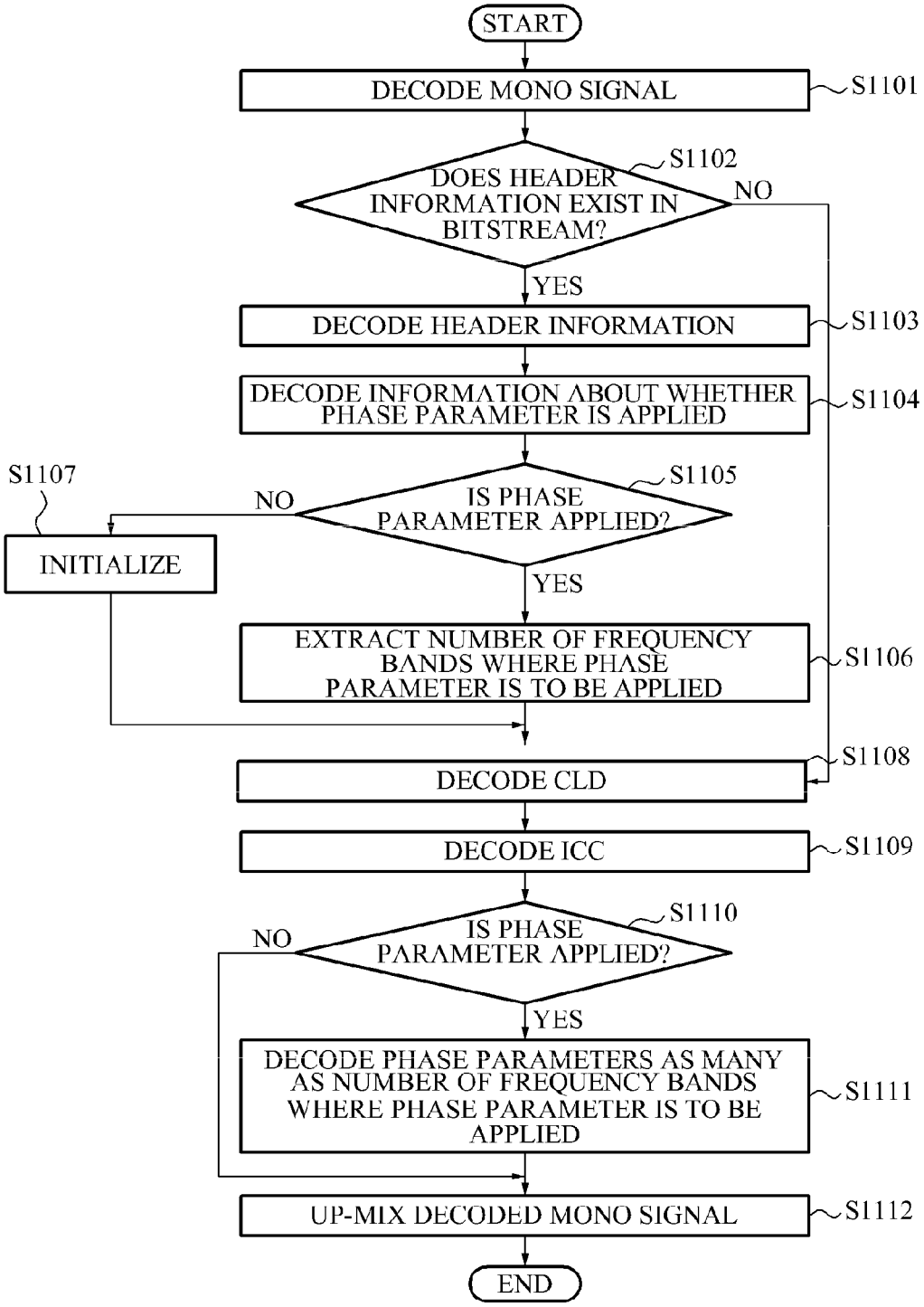
FIGS. 11 through 13 are flowcharts illustrating a method of encoding a multi-channel signal according to another example embodiment.
Figure 12:
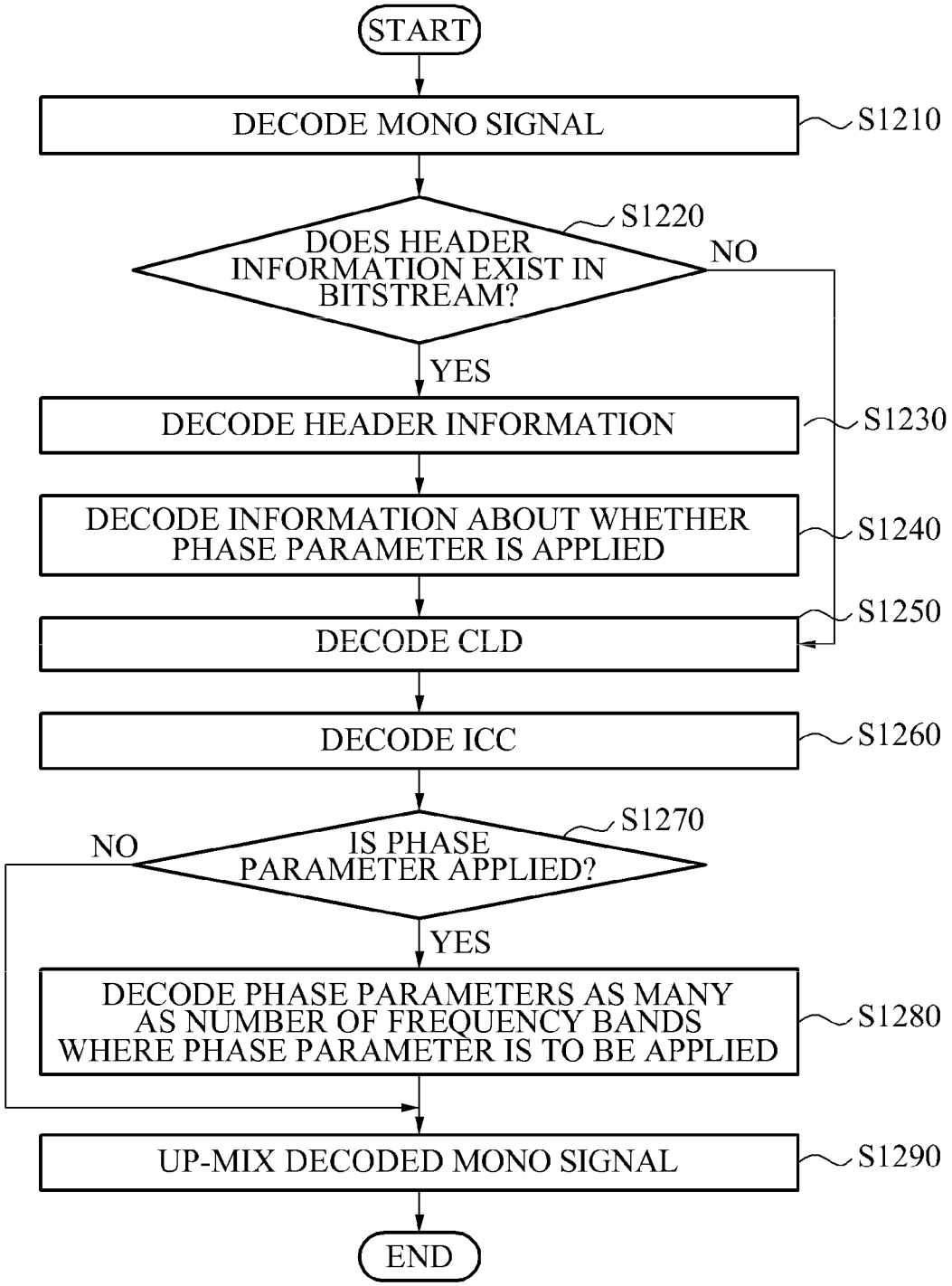
Figure 13:
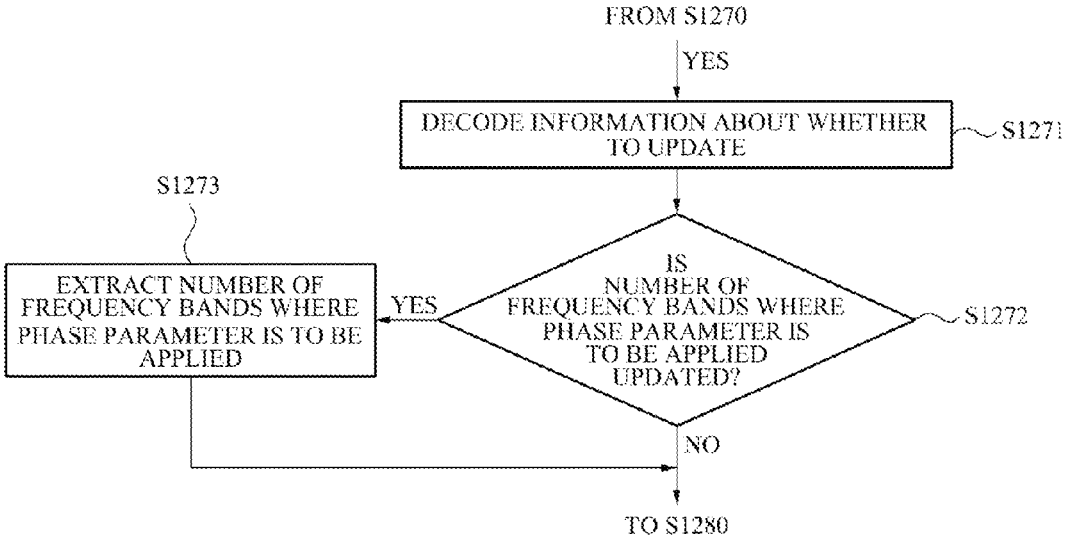

FIGS. 11 through 13 are flowcharts illustrating a method of encoding a multi-channel signal according to another example embodiment.

FIG. 11 is a flowchart illustrating a method of decoding a bitstream illustrated in FIGS. 3 (*a*) and (*b*).

In operation S1101, a mono signal may be decoded from a bitstream which the multi-channel signal is encoded. The mono signal may be a down-mix signal of the multi-channel signal.

In operation S1102, it may be ascertained whether header information exists in the bitstream.

When it is ascertained that the header information exists in the bitstream in operation S1102, decoding may be performed in operation S1108.

When it is ascertained that the header information does not exist in the bitstream in operation S1102, the header information may be decoded in operation S1103 and information about whether a phase parameter is applied may be decoded in operation S1104.

In operation S1105, it may be determined whether the phase parameter is applied based on the decoded information.

When it is determined that the phase parameter is not applied in operation S1105, a number of frequency bands which the phase parameter is to be applied and the phase parameter may be initialized as '0' in operation S1107.

When it is determined that the phase parameter is applied in operation S1105, and the bitstream is configured as illustrated in FIG. 3 (*a*), the number of frequency bands which the phase parameter is to be applied may be extracted in operation S1106. Also, when it is determined that the phase parameter is applied in operation S1105, and the bitstream is configured as illustrated in FIG. 3 (*b*), frequency band information corresponding to the mono signal may be selected from a table, and a frequency band may be determined in operation S1106. Frequency band information about the frequency band may be stored in the table.

In operation S1108, a CLD indicating an energy level difference of channels may be decoded. In operation S1109, an ICC indicating a correlation of channels may be decoded.

In operation S1111, it may be determined whether the phase parameter is applied.

When it is determined that the phase parameter is applied in operation S1111, phase parameters as many as a number of frequency bands which the phase parameter is to be applied may be decoded in operation S1111. In operation S1112, the decoded mono signal may be up-mixed based on the decoded phase parameter.

When it is determined that the phase parameter is not applied in operation S1111, the decoded mono signal may be up-mixed in operation S1112, without decoding in operation S1111.

FIG. 12 is a flowchart illustrating a method of decoding a bitstream illustrated in FIG. 3 (*d*).

In operation S1210, a mono signal may be decoded from a bitstream which the multi-channel signal is encoded. The mono signal may be a down-mix signal of the multi-channel signal.

In operation S1220, it may be ascertained whether header information exists in the bitstream.

When it is ascertained that the header information does not exist in the bitstream in operation S1220, decoding may be performed in operation S1250.

When it is ascertained that the header information exists in the bitstream in operation S1220, the header information may be decoded in operation S1230.

In operation S1240, information about whether a phase parameter is applied may be decoded. In operation S1250, a CLD may be decoded. In operation S1260, an ICC may be decoded.

In operation S1270, it may be determined whether the phase parameter, is applied.

When it is determined that the phase parameter is applied in operation S1270, a same number of phase parameters as a number of frequency bands which the phase parameter is to be applied may be decoded in operation S1280. In operation S1290, the decoded mono signal may be up-mixed based on the decoded phase parameter.

When it is determined that the phase parameter is not applied in operation S1270, the decoded mono signal may be up-mixed in operation S1290, without decoding in operation S1280.

FIG. 13 is a flowchart illustrating a method of decoding a bitstream, illustrated in FIG. 3 (*c*), which is associated with FIG. 12.

When it is determined that the phase parameter is applied in operation S1270, information about whether to update the number of frequency bands which the phase parameter is to be applied may be decoded in operation S1271.

In operation S1272, it may be determined whether the number of frequency bands which the phase parameter is to be applied is updated.

When it is determined that the number of frequency bands which the phase parameter is to be applied is updated in operation S1272, the number of frequency bands which the phase parameter is to be applied may be extracted in operation S1273. In this case, the phase parameter may be decoded using the extracted number of frequency bands.

When it is determined that the number of frequency bands which the phase parameter is to be applied is not updated in operation S1272, the phase parameter may be decoded using a number of frequency bands which the phase parameter is to be applied in a previous frame in operation S1280, without decoding in operation S1273.

Example embodiments include computer-readable media including program instructions to implement various operations embodied by a computer. The media may also include, alone or in combination with the program instructions, data files, data structures, tables, and the like. The media and program instructions may be those specially designed and constructed for the purposes of example embodiments, or they may be of the kind well known and available to those having skill in the computer software arts. Examples of computer-readable media include magnetic media such as hard disks, floppy disks, and magnetic tape; optical media such as CD ROM disks; magneto-optical media such as floptical disks; and hardware devices that are specially configured to store and perform program instructions, such as read-only memory devices (ROM) and random access memory (RAM). Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa.

Although a few example embodiments have been shown and described, the present disclosure is not limited to the described example embodiments. Instead, it would be appreciated by those skilled in the art that changes may be made to these example embodiments without departing from the principles and spirit of the disclosure, the scope of which is defined by the claims and their equivalents.

The invention claimed is:

1. A method for decoding a multichannel signal, comprising:

decoding a downmixed mono signal from a bitstream;

obtaining a band information for a phase parameter, if it is determined that the phase parameter is available for a current frame based on additional information included in the bitstream;

decoding, performed by at least one processing device, the phase parameter included in the bitstream; and up-mixing the downmixed mono signal using the phase parameter based on the band information.

2. The decoding method of claim 1, wherein the phase parameter includes an IPD (Inter-channel Phase Difference).

3. The decoding method of claim 1, wherein in the up-mixing, if a number of at least one band for the phase parameter is not transmitted as the band information via the bitstream, the downmixed mono signal is up-mixed by using the phase parameter based on a table in a decoder side.

4. The decoding method of claim 1, wherein in the up-mixing, if a number of at least one band for the phase parameter is transmitted as the band information via the bitstream, the downmixed mono signal is up-mixed by using the phase parameter based on the number of the at least one band.

* * * * *